US008314537B2

(12) United States Patent
Gielen et al.

(10) Patent No.: US 8,314,537 B2
(45) Date of Patent: Nov. 20, 2012

(54) ELECTRIC LAMP

(75) Inventors: Vincent S. D. Gielen, Eindhoven (NL); Johannes P. M. Ansems, Eindhoven (NL); Berend J. W. Ter Weeme, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/128,945

(22) PCT Filed: Nov. 12, 2009

(86) PCT No.: PCT/IB2009/055020

§ 371 (c)(1),
(2), (4) Date: May 12, 2011

(87) PCT Pub. No.: WO2010/058325

PCT Pub. Date: May 27, 2010

(65) Prior Publication Data

US 2011/0248618 A1 Oct. 13, 2011

(30) Foreign Application Priority Data

Nov. 18, 2008 (EP) ..... 08169325

(51) Int. Cl.
*H01J 1/02* (2006.01)

(52) U.S. Cl. ..... 313/46; 362/545; 362/249.02

(58) Field of Classification Search ..... 257/40, 257/72, 98–100, 642–643, 759; 313/498–512; 315/169.1, 169.3; 427/58, 64, 66, 532–535, 427/539; 428/690–691, 917; 438/26–29, 34, 82, 455; 445/24–25; 362/543–549, 555, 800, 249.01–249.03
See application file for complete search history.

(56) References Cited

U.S. PATENT DOCUMENTS

| | | | | |
|---|---|---|---|---|
| 5,806,965 | A | 9/1998 | Deese | |
| 6,525,668 | B1 | 2/2003 | Petrick | |
| 2003/0038291 | A1 * | 2/2003 | Cao | 257/81 |
| 2004/0079957 | A1 * | 4/2004 | Andrews et al. | 257/100 |
| 2004/0195947 | A1 * | 10/2004 | Clark et al. | 313/46 |

(Continued)

FOREIGN PATENT DOCUMENTS

DE 202004013773 U1 12/2004

(Continued)

*Primary Examiner* — Mariceli Santiago
*Assistant Examiner* — Donald Raleigh
(74) *Attorney, Agent, or Firm* — John F. Salazar; Mark L. Beloborodov

(57) ABSTRACT

A bulb-type LED lamp (1) has a bulb (3) mounted on a socket (5). A light source (7), comprising a plurality of LEDs mounted on a PCB (9), is arranged inside the bulb (3). The PCB (9) acts as and/or is connected to cooling means (21). The outer surface (15) of the bulb is formed both by light transmittable surface (22) and/or sub-areas (23) thereof and the cooling means (21), which cooling means extend from inside the bulb into the outer surface of the bulb. Surfaces are mutually flush at locations at the outer surface of the bulb where said surfaces of both the cooling means and the light transmittable sub-areas border each other. The spatial light intensity distribution of the lamp of the invention is significantly improved over the prior art bulb-type LED lamp.

14 Claims, 9 Drawing Sheets

U.S. PATENT DOCUMENTS

2004/0202005 A1 10/2004 Moisel
2005/0073244 A1* 4/2005 Chou et al. ..... 313/498
2005/0092469 A1 5/2005 Huang
2005/0127377 A1* 6/2005 Arndt et al. ..... 257/81
2008/0048200 A1* 2/2008 Mueller et al. ..... 257/98
2010/0060130 A1* 3/2010 Li ..... 313/46

FOREIGN PATENT DOCUMENTS

EP 1047903 B1 6/2007
WO 2010136920 A1 12/2010

* cited by examiner

ELECTRIC LAMP

FIELD OF THE INVENTION

The invention relates to an electric lamp comprising:
a bulb mounted on a socket,
cooling means for cooling the lamp during operation,
a semiconductor light source arranged inside the bulb,
a lamp axis extending through a central end of the socket and a central extreme of the bulb,
the bulb having an outer surface comprising a light transmittable surface for transmitting light originating from the light source during operation of the lamp.

BACKGROUND OF THE INVENTION

Such a lamp is known from U.S. Pat. No. 5,806,965. In the known lamp a substantially omnidirectional cluster of individual LEDs are electrically mounted on Printed Circuit Boards (PCB). The same intensity of light as standard incandescent bulbs (GLS) can be generated by said cluster of LEDs at a fraction of the power consumption of a standard GLS. In order to render the known lamp safe to consumers, it is provided with a protective bulb, i.e. a dome, to protect the consumer from exposure to the electrical circuitry within said dome. As a result, the known lamp has the disadvantage that the desired omnidirectional light distribution is hampered by the base plate (lower wall) on which the dome is mounted. Furthermore, the provision of the protective dome over the PCBs and LEDs results in the known lamp having the disadvantage of decreased/insufficient cooling efficiency.

SUMMARY OF THE INVENTION

It is an object of the invention to provide a bulb-type LED lamp of the type described in the opening paragraph, in which at least one of the disadvantages is counteracted. To achieve this, the lamp is characterized in that both the cooling means and the light transmittable surface are spread over the bulb outer surface, such that for an imaginary set of two planes, of which a first plane extends parallel to the axis and a second plane extends perpendicularly to the axis, a position of said planes can be found in which at least one of said two planes crosses at least two times a boundary between the cooling means and the light transmittable surface. "Bulb" in this respect is to be understood to include a variety of shapes, for example a rounded spherical shape, a tube-like shape, or a polyhedron shape, for example a dodecahedron, hexagon, or octahedron. The semiconductor light source should be understood to include OLEDs, LEDs, opto-electrical devices. The imaginary planes crossing at least twice a boundary between cooling means and the light transmittable surface is an indication that said cooling means and light transmittable surface are patched. For the lamp to be cooled efficiently, i.e. to have enough cooling capacity and enough emission of light, the inventors gained the insight that both the cooling means and the light transmittable surface should form the bulb outer surface and should be spread, for example patched, over the bulb outer surface. Spreading the cooling means over the bulb outer surface increases the surface area of the cooling means exposed to the ambient atmosphere, and hence increases/improves the cooling capacity of the lamp, however, without any, or only little, increase in the size of the lamp. In the known lamp, an increase of the cooling means would have led to a large, bulky lamp. Spreading the light transmittable surface over the bulb outer surface results in the omnidirectional light distribution being improved over the known lamp. In the known lamp the desired omnidirectional light distribution is hampered by the base plate (lower wall) on which the dome is mounted. This phenomenon is counteracted in the lamp of the invention.

To further improve the cooling capacity of the lamp, an embodiment of the electric lamp is characterized in that the cooling means extend from inside the bulb into the outer surface of the bulb, thus forming part of the outer surface of the bulb. Hence, the outer surface of the bulb need not be a closed surface but may be formed by distinguishable parts that, for example, are flush at the outer surface of the bulb. Optionally, the bulb outer surface may be provided with a coating, for example for decorative purposes, to improve the radiative properties of the cooling means, or to smoothen the outer surface of the bulb. The light source can comprise a cluster of LEDs, which cluster of LEDs can be distributed in sub-groups of LEDs by the cooling means in the lamp of the invention. The technical measures involve that the cooling efficiency of the lamp is improved, as the cooling means has a significantly increased cooling surface and the cooling surface is exposed directly to the ambient atmosphere without a (thermally isolating) protective cover, thus allowing free flowing air to flow along the cooling areas, for example due to convection. Preferably, the cooling means is evenly distributed over the entire bulb outer surface, rendering a thermal performance independent of lamp orientation during operation. To promote the cooling of the lamp, the cooling means preferably has a coefficient of thermal conductivity of at least 1 W/mK, more preferably 10 W/mK or even more preferably 20 W/mK or more, up to 100 or 500 W/mK. Suitable materials for the cooling means are metals such as aluminum, copper, alloys thereof, or thermally conductive plastics, for example as available via Coolpoly®, for example white/black Coolpoly® D3606 having a thermal conductivity of 1.5 W/mK, or white Coolpoly® D1202 having a thermal conductivity of 5 W/mK.

In an embodiment the electric lamp is characterized in that the light transmittable surface is divided into sub-areas by the cooling means. As a result, the lamp has the advantage that the light distribution may be tuned, for example via setting the orientation of sub-areas and the associated sub-group of LEDs from the cluster of LEDs. In an alternative embodiment, the light distribution may be controlled via controlling the intensity of the subgroups of LEDs, and/or possibly even within subgroups the intensity of individual LEDs may be controlled. By setting the orientation and/or intensity of the sub-areas it is enabled that the lamp exhibits an equal luminous intensity to an observer within a space angle of 300°, i.e. the equal luminous intensity is observed from all directions except from directions within a cone around the socket, having its apex on the axis inside the bulb, with the cone having an apex angle of 60°. "Equal luminous intensity" in this respect means an average light intensity with a variation of plus or minus 15%.

In a further embodiment the electric lamp is characterized in that the sub-areas have the same shape and/or size. As a result, the lamp has the advantage of being relatively easy to manufacture, as the number of different lamp parts is reduced.

In a yet further embodiment the electric lamp is characterized in that the sub-areas form an integral light transmittable surface and the sub-areas and the cooling means are arranged in an interdigitated/forked/alternating configuration. This results in the lamp having the advantage that the light transmittable surface and/or cooling means each form only one integral lamp part and that the number of lamp parts is thus significantly reduced.

In another embodiment the electric lamp is characterized in that each sub-area is surrounded by a respective part of the cooling means. As a result, the lamp has the advantage that a relatively very efficient cooling is obtained; for example in the case where the light source comprises sub-groups of LEDs, each sub-group of LEDs is proximate to its associated cooling means. Preferred embodiments are electric lamps in which the sub-areas are separated by at least two axially extending cooling arches, for example 2, 3, 4, 5 6, or 8 arches. In particular in the case where the cooling arches are evenly distributed over the circumference of the outer surface of the bulb, and the light transmittable sub-areas have the same shape, a rotationally symmetric bulb is obtained with, for example, a four-fold or seven-fold rotation axis symmetry. Alternative embodiments are electric lamps in which the sub-areas are separated by at least one annular or ring-shaped cooling means around the axis, for example 2, 3 or 4 rings. The bulb then has a favorable rotational symmetry with, for example, a two-fold, three-fold or four-fold rotational axis. In the above-mentioned embodiments the number of sub-areas is in the range of 2 to 8, but said number could easily be chosen differently, for example more than 8 and up to 36 or 144 sub-areas, or a higher number of sub-areas.

In a further preferred embodiment the electric lamp is characterized in that each sub-area is a light transmittable part which is releasably fixed onto the cooling means. A particularly convenient embodiment is an electric lamp in which the releasable fixation occurs via a click/snap connection which enables the light transmittable parts to be readily exchanged. By virtue of the replaceability feature, the lamp has the advantage that preferred properties of light transmittable parts may be chosen and the lamp beam properties may be adjusted at will. The light transmittable parts may be provided, for example, with a diffusely transparent or translucent part which optionally is provided with a reflective pattern, or for example, with a transparent part which is provided with a chosen blend of remote phosphor material to set the color or color temperature of the lamp. If the light transmittable part is an optical element via which the direction of the light rays is controlled, the beam characteristics or the light distribution is relatively easily adjustable.

The cooling means in the electric lamp can be embodied as a massive, solid, bulk structure in which heat conduction from inside the bulb to the outer surface of the cooling means and to the outer surface of the bulb solely occurs via the bulk of the material. Alternatively, however, the cooling means may be formed as recesses that extend inwardly, i.e. from the outer surface of the bulb towards the axis. In this embodiment the cooling means have a relatively large outer surface, with heat conduction only taking place over a relatively short distance through the bulk of the material of the cooling means before the heat reaches the outer surface of the cooling means where subsequently heat can be dissipated to free flowing ambient air. Thus, efficient cooling of the lamp is attained.

A still further embodiment of the electric lamp is characterized in that the cooling means comprise both passive cooling means and active cooling means. Passive cooling means perform cooling essentially without power consumption, often by means of natural convention. Active cooling means control heat dissipation via forced flow of a heat transporting fluid, for example air, oil or water, and thereby consume power. However, active cooling means renders the advantage of more, and better controlled cooling.

A still further embodiment of the electric lamp is characterized in that the lamp is a DC-driven lamp and that the lamp has a central axially extending cavity in which a lamp driver is arranged, said cavity being a convenient location for the driver to be accommodated inside the lamp, as it is adjacent the cooling means of the lamps. Alternatively the lamp is an AC-driven lamp, in which case the driver can be omitted and the lamp can be provided with a standard Edison-fitting, enabling it to be suitably used as a retrofit lamp for standard GLS lamps. For the convenience of the consumer, the bulb shape is preferably in accordance with the shape of a conventional GLS bulb, though alternative bulb shapes are equally possible.

BRIEF DESCRIPTION OF THE DRAWINGS

These and other aspects of the invention will now be further elucidated by means of the schematic drawing, in which.

DETAILED DESCRIPTION OF THE EMBODIMENTS

Figure 1A:
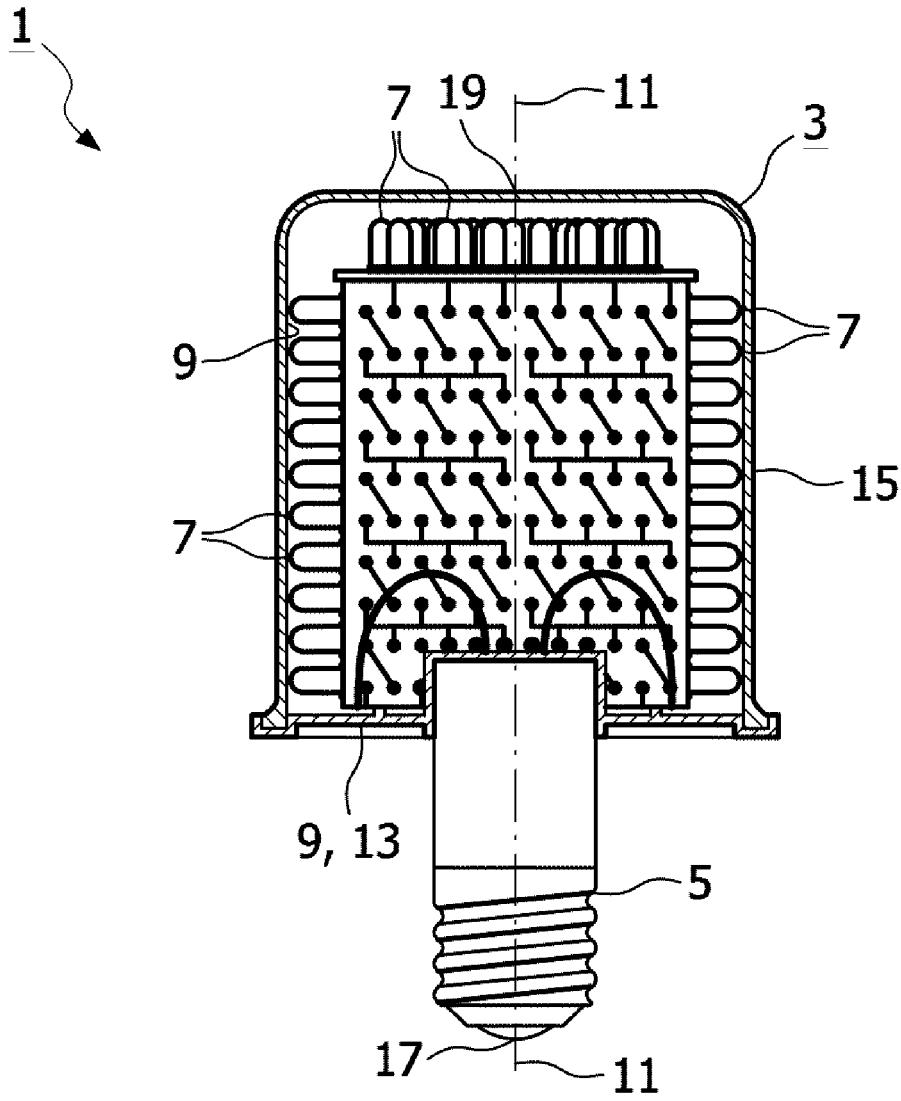
FIG. 1A (PRIOR ART)
FIG. 1A shows an electric lamp according to the prior art.

In FIG. 1A a bulb-type LED lamp according to the prior art is shown. The lamp 1 has a bulb 3 mounted on a socket 5. A light source 7, comprising a plurality of LEDs mounted on a PCB 9, is arranged inside the bulb 3. The PCB 9 is provided with venting holes that function as cooling means (not shown). A part of the PCB is formed as a base plate 13 on which the bulb 3, embodied as a protective dome, is mounted, said dome surrounding the light source and parts of the PCB and the cooling means. The dome has a translucent outer surface 15 for transmitting light originating from the light source during operation of the lamp. A lamp axis 11 extends through a central end 17 of the socket and a central extremity 19 of the bulb.

Figure 1B:
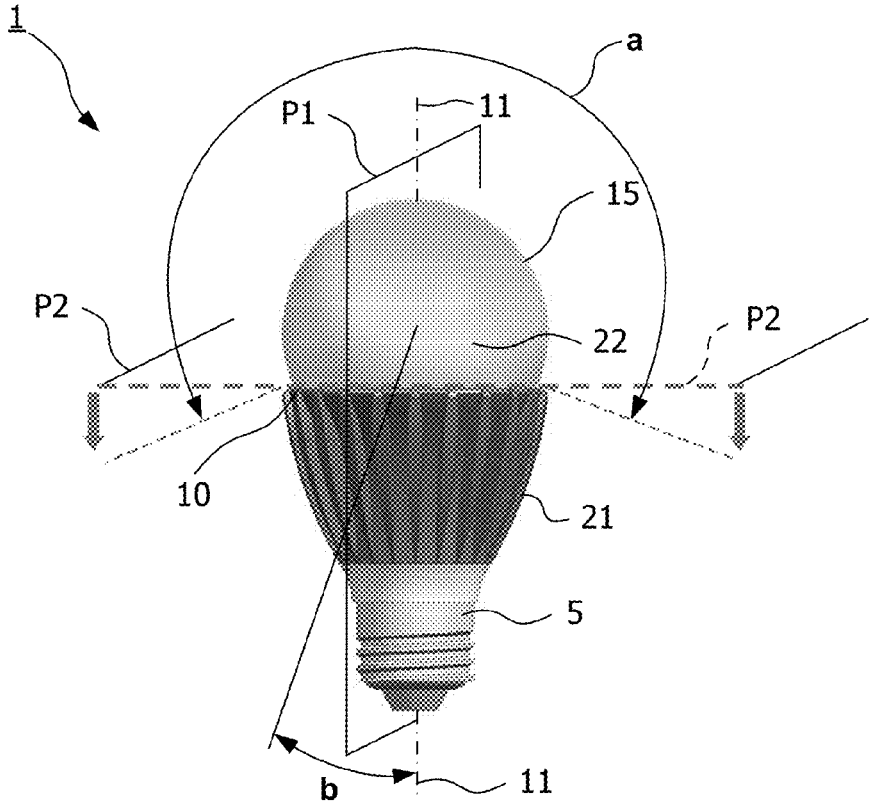
FIG. 1B (PRIOR ART)
FIG. 1B shows another lamp according to the prior art.
Figure 1C:
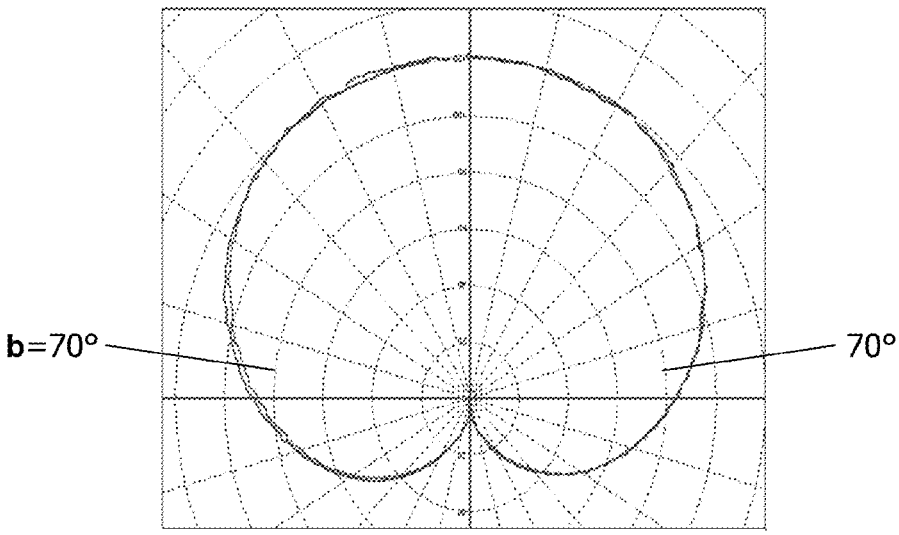
FIG. 1C (PRIOR ART)
FIG. 1C shows the light distribution of the prior art lamp of FIG. 1B.

FIG. 1B shows a side view of another bulb-type LED lamp 1 according to the prior art. In this prior art lamp the bulb 3 is mounted on the cooling means 21 which is separated from a light transmittable surface 22 of the bulb outer surface 15. The bulb 3 is mounted via the cooling means in the socket 5. The cooling means are rather bulky, but this is required to attain the right amount of cooling capacity. The cooling means hamper the distribution of light as emitted by the light source through the light transmittable surface 22, resulting in an emission space angle α of about 220°. The spatial light intensity distribution of the lamp of FIG. 1B as a function of the angle β is shown in FIG. 1C. In the plot shown in FIG. 1C, the angle β=0° refers to the light intensity as measured along the axis 11 in the direction from socket 5 towards bulb 3. As is clearly shown in FIG. 1C the light intensity is only at the required level at angles β of over 70°; at smaller angles β the light intensity is too low, i.e. more than 15% below the average light intensity output. In FIG. 1B furthermore is shown that with respect to a first plane P1 parallel to the axis 11 and a second plane P2 perpendicular to the axis 11, no position can be found in which at least one of said planes P1,P2 crosses at least two times a boundary 10 between the cooling means and the light transmittable surface. The plane P1 crosses the boundary 10 only once, while the plane P2 does not cross any boundary.

Figure 2A:
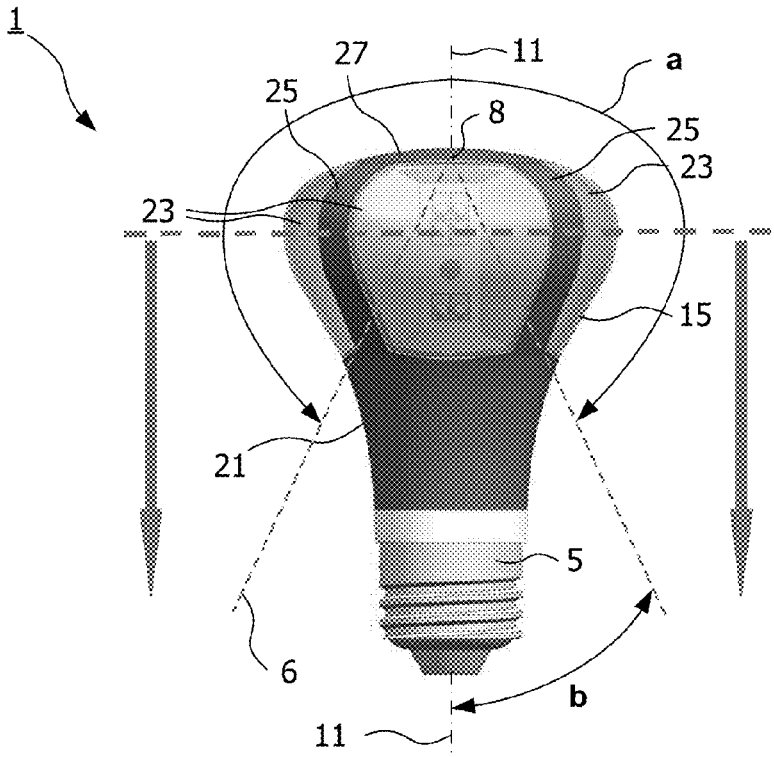
FIG. 2A shows a side view of a first embodiment of the electric lamp according to the invention.
Figure 2B:
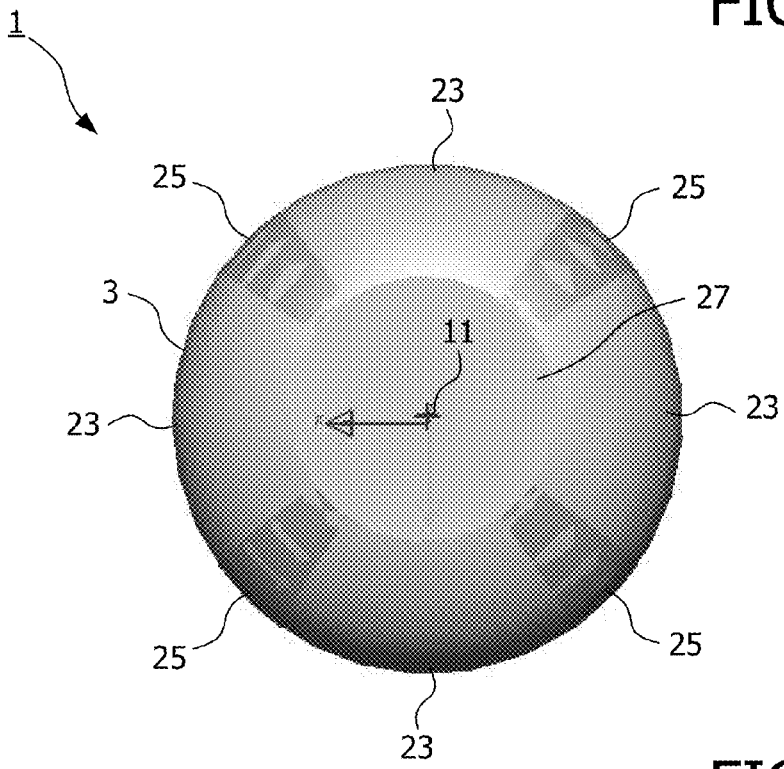
FIG. 2B shows a top view of the lamp of FIG. 2A.
Figure 2C:
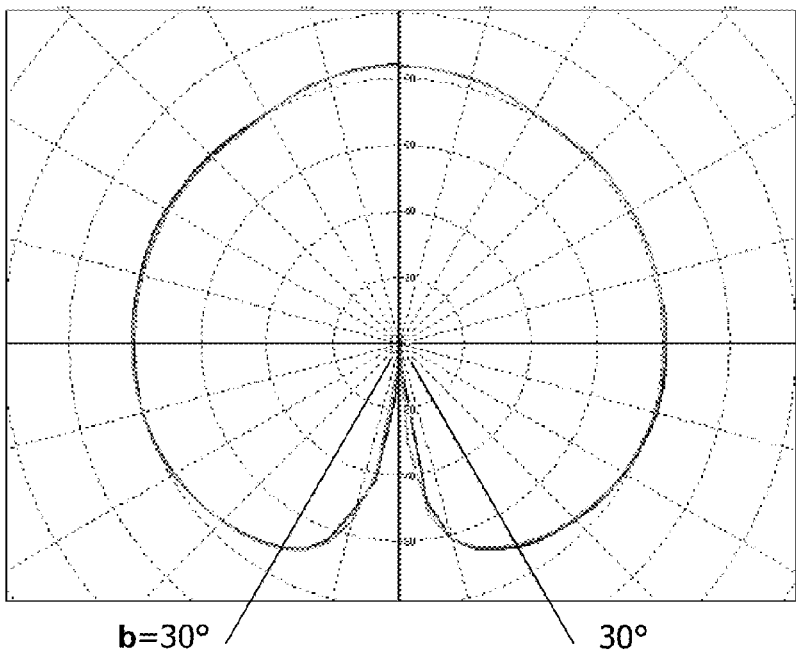
FIG. 2C shows the light distribution obtained by the lamp of FIG. 2A.

In FIG. 2A a side view of a first embodiment of the lamp 1 according to the invention is shown. The lamp has a socket 5, a convenient E27 Edison fitting, in which the bulb 3 comprising cooling means 21 is mounted. The outer surface 15 of bulb 3 is formed both by light transmittable surface sub-areas 23, four arches 25 (of which only two are shown) and an adjoining top 27 of the cooling means, which feature is more clearly visible in the top view shown in FIG. 2B along axis 11. The cooling means extend from inside the bulb into the outer surface of the bulb and are formed as solid arches. In the embodiment of FIG. 2A, surfaces are mutually flush at locations at the outer surface of the bulb where said surfaces of both the cooling means and the light transmittable sub-areas border each other. The cooling means hamper only to a small extent the distribution of light as emitted by the light source (not shown) through the light transmittable surface 15, and to a significantly lesser degree than the prior art lamp as shown in FIG. 1B. The spatial light intensity distribution of the lamp of FIG. 2A as a function of the angle β is shown in FIG. 2C. In the plot shown in FIG. 2C, the angle β=0° refers to the light intensity as measured along the axis 11 in the direction from socket 5 towards bulb 3. As is clearly shown in FIG. 2C the light intensity is already at the required level at angles β of 30°, i.e. more than 15% below the average light intensity output, resulting in an emission space angle α of about 300°; other angles α, for example α=280° or α=310°, are equally possible by selecting the appropriate light transmittable sub-areas or by adjusting the orientation of sub-groups of the light source. Angle β forms half the angle of the angle of an apex 8 of cone 6 around the socket 5 (see FIG. 2A).

Figure 2D:
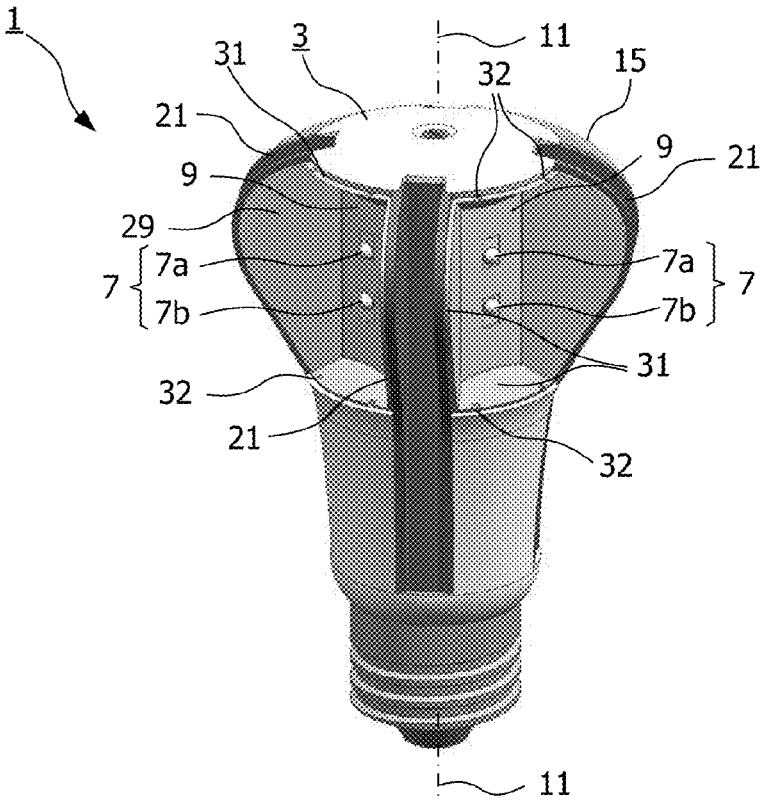
FIG. 2D shows a perspective view, partly broken away, of a second embodiment of the lamp according to the invention.

In FIG. 2D a perspective view, partly broken away, of a second embodiment of the lamp 1 according to the invention is shown, i.e. the light transmittable sub-areas are formed by releasably fixed light transmittable parts, of which two are left out, which light transmittable parts are provided with click/snap elements enabling easy assembly onto the lamp by interconnecting with clicking elements 32 provided on the cooling means 21. Some of the components inside the bulb 3 are visible, including the light source 7 which is made up of a plurality of LEDs 7*a*,7*b* mounted on a PCB 9, and cooling means 21 which extend from the PCBs inside the bulb into the outer surface 15 of the bulb. The PCBs are arranged around axis 11. The cooling means are shaped as recesses extending from the bulb outer surface towards the axis and are coated on a side 29 facing the LEDs with a reflective coating 31 to counteract light losses due to absorption of light by the cooling means and thus to increase the efficiency of the lamp. Each PCB and subgroups of LEDs is proximate to its respective cooling means, and as a result a relatively very efficient cooling is obtained. The LEDs can comprise: —a combination of Red, Green, Blue, White (RGBW) LEDs, —RGBW—Amber LEDs, —LEDs of different color temperature, —LEDs which are all of the same color, or Blue/UV-LEDs in combination with a remote phosphor provided on or in the light transmittable parts. In the lamp of FIG. 2D the LEDs are of different color temperature, i.e. 2500K and 7000K, of which the emission intensity can be controlled independently to adjust the emitted color temperature of the lamp.

Figure 3A:
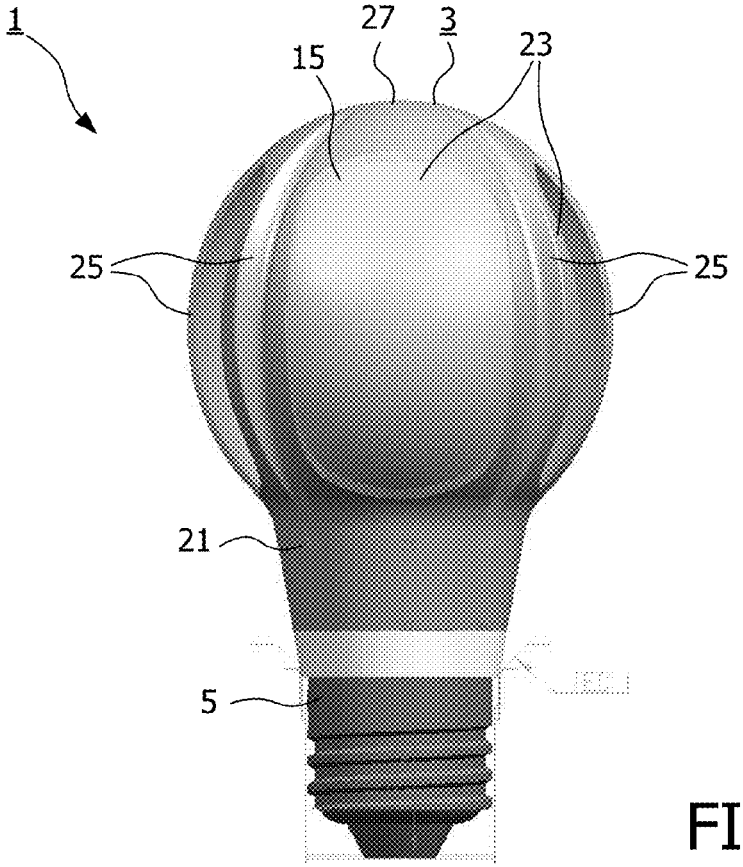
FIG. 3A shows a side view of a third embodiment of the lamp according to the invention.
Figure 3B:
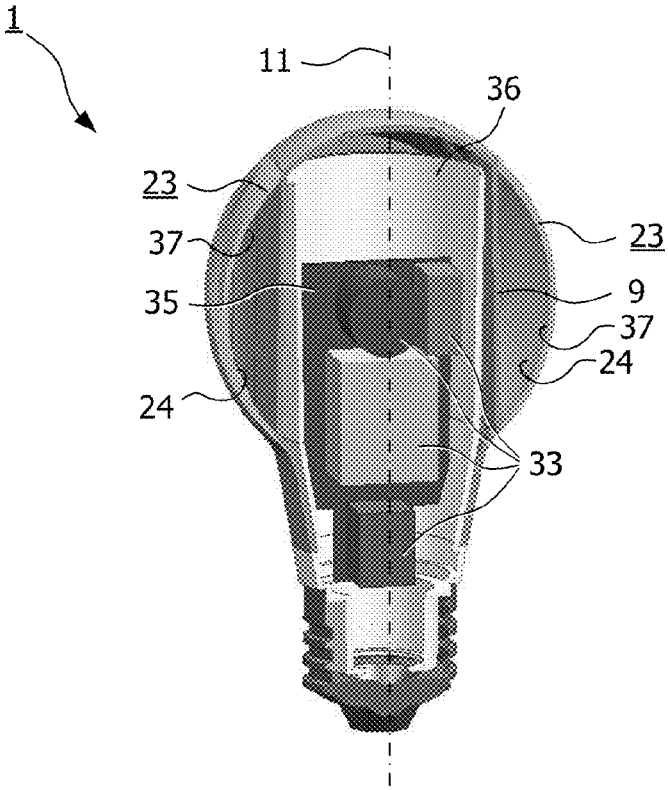
FIG. 3B shows a vertical cross-section of the lamp of FIG. 3A.

FIG. 3A shows a side view of a third embodiment of the lamp 1 according to the invention. The lamp has a socket 5, a convenient E27 Edison fitting, in which the bulb 3 comprising cooling means 21 is mounted. The outer surface 15 of the bulb is formed both by six light transmittable surface sub-areas 23 of the same shape, six corrugated arches 25 (of which only four are shown) and an adjoining top 27 of the cooling means. In the lamp of FIG. 3A the light transmittable sub-areas each are surrounded by respective cooling means. The cooling means are not flush with the light transmittable surface but are partly laid over said surface, such that the cooling means together with the light transmittable surface form an undulated bulb outer surface. The cooling means in this lamp do not extend from inside the bulb into and beyond the outer surface 15 of the bulb, but only form part of the bulb outer surface. FIG. 3B shows a vertical cross-section of the lamp 1 of FIG. 3A. As the lamp is a DC lamp, an electronic driver circuit 33 is provided inside a cavity 35 in the bulb 3 which converts the alternating mains voltage into an appropriate DC voltage. The cavity 35 has an annular outer wall formed by the PCBs 9 of heat conducting material around the axis 11, and thus acts as a cooling means, on which PCBs the LEDs (not shown) are (to be) mounted, the six arches being thermally connected to said wall at the bulb outer surface, and an electrically insulating wall 36 shielding the driver from the PCBs. Thus, efficient cooling of both the LEDs and the driver circuit is obtained. The lamp of FIG. 3B comprises Blue-LEDs whose radiation is converted into visible light by a remote phosphor YAG-Ce coating 37 which is provided on an inner surface 24 of the light transmittable sub-areas 23.

Figure 4:
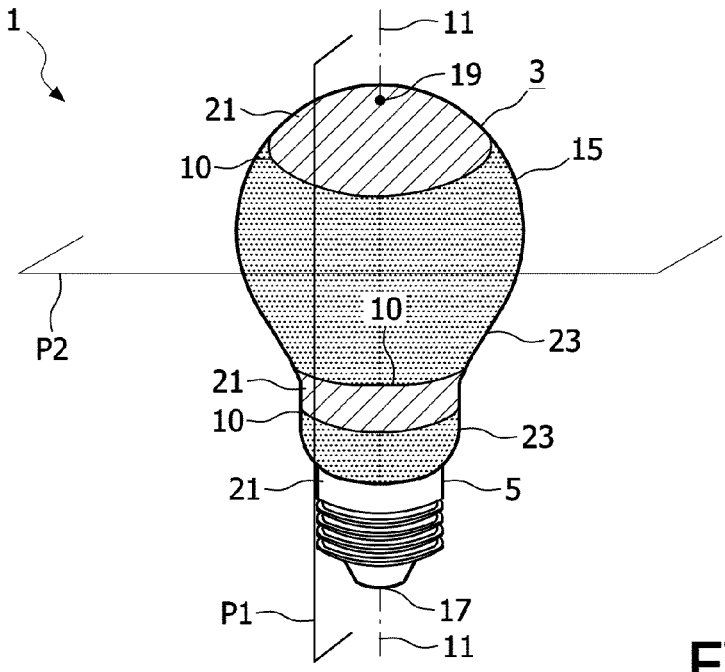
FIG. 4 shows a fourth embodiment of a lamp according to the invention.
Figure 5:
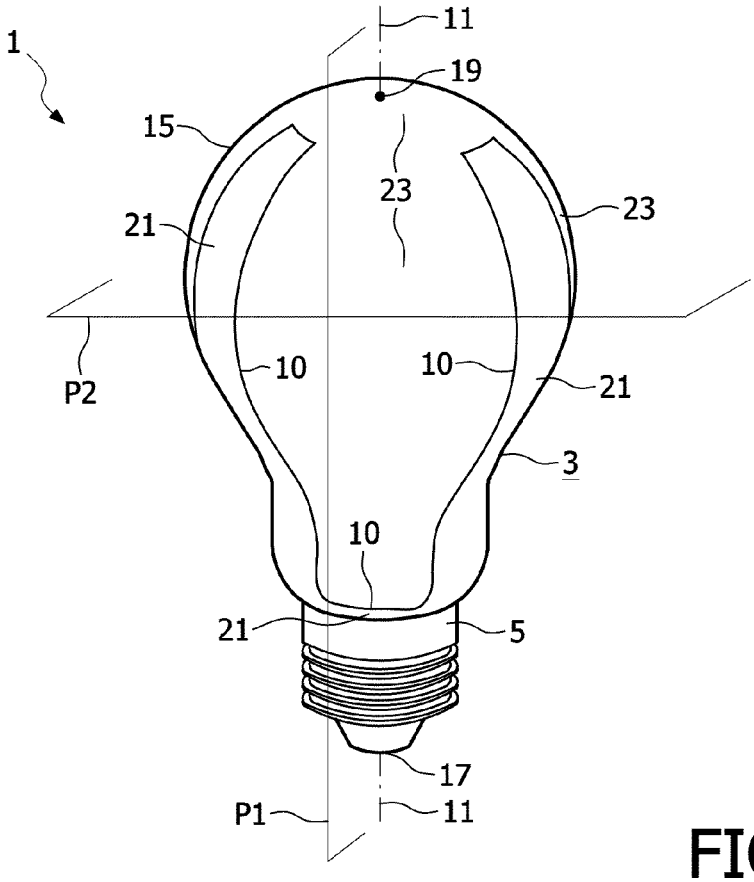
FIG. 5 shows a fifth embodiment of a lamp according to the invention.
Figure 6:
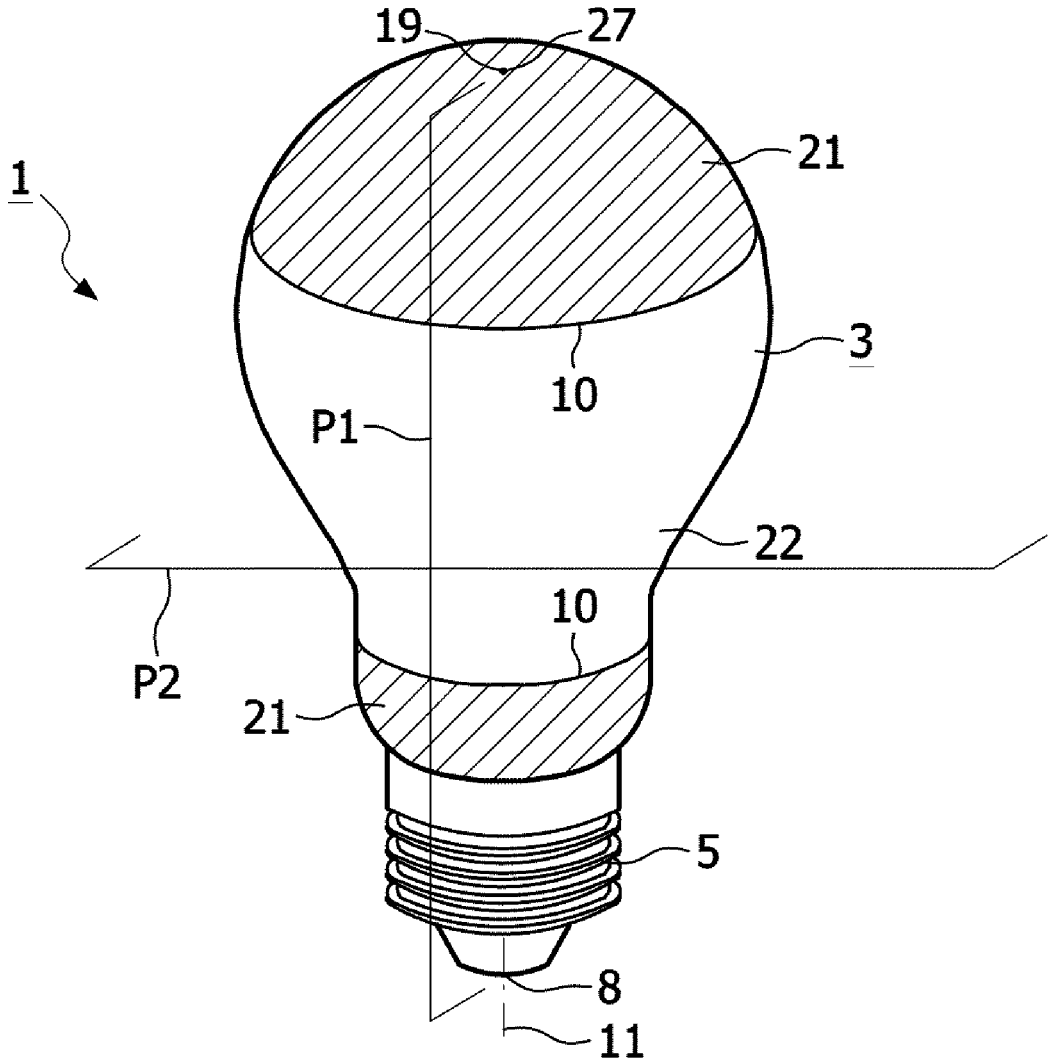
FIG. 6 shows a sixth embodiment of a lamp according to the invention.
Figure 7:
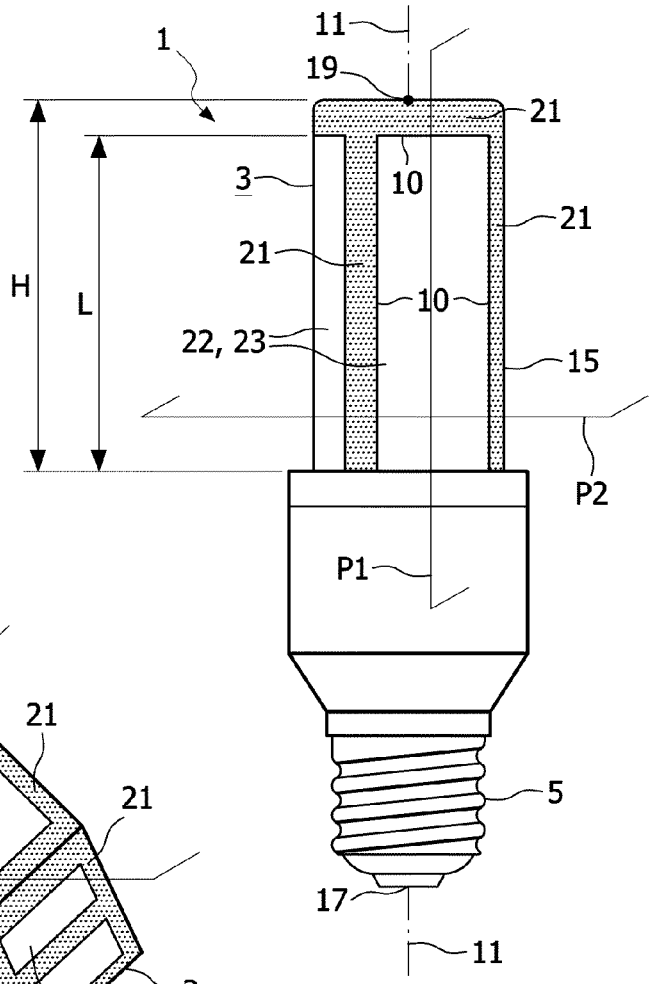
FIG. 7 shows a seventh embodiment of a lamp according to the invention.
Figure 8:
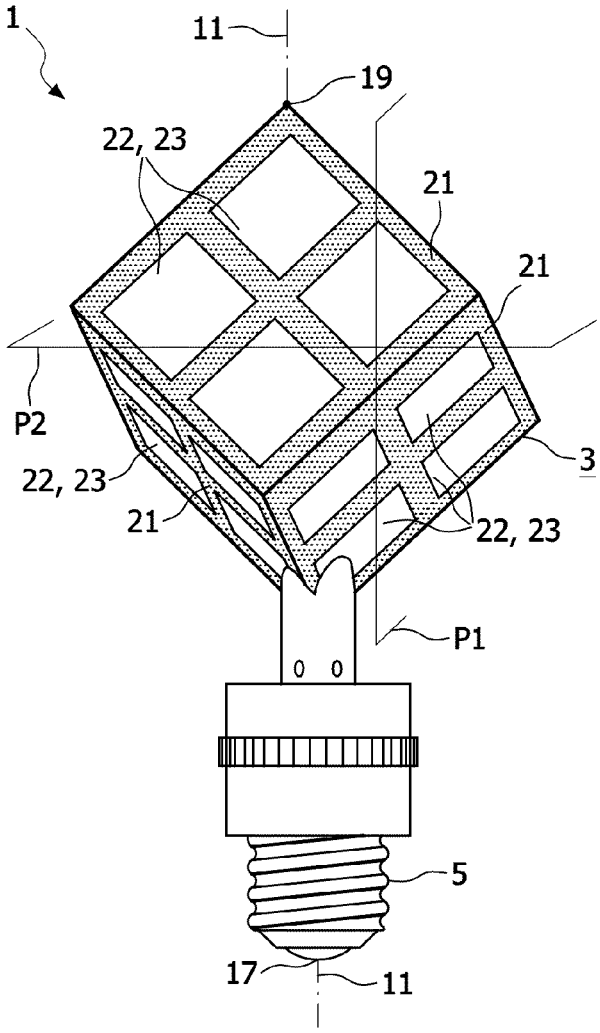
FIG. 8 shows an eighth embodiment of a lamp according to the invention.

FIG. 4 to FIG. 8, respectively, show a fourth, a fifth, a sixth, a seventh and an eighth embodiment of a lamp 1 according to the invention in which on the outer surface 15 of the bulb 3 alternative arrangements of cooling means 21 and light transmittable sub-areas 23 are shown. All embodiments have excellent cooling properties. The lamp in FIG. 4 has parallel annular rings of cooling means; the lamp in FIG. 5 has an interdigitated structure (finger-like or comb-like structure) of the cooling means 21 with the light transmittable sub-areas 23. Three finger-like cooling areas form an interdigitated structure with three sub-areas of the light transmittable surface. The lamp 1 in FIG. 6 shows an embodiment in which the cooling means 21 are arranged adjacent the socket 5 and at the top 27 of the lamp comprising one integral light transmittable surface 22, i.e. without intermediate sub-areas. FIGS. 7 and 8 show alternative embodiments of the shape of the bulb, i.e. in FIG. 7 the bulb is tube-shaped and in FIG. 8 the bulb is a six-sided polygon (hexagon) with a patched structure formed by the cooling means and the sub-areas 23 of the light transmittable surface 22. Furthermore, in each of said FIGS. 4 to 8, a plane P1 parallel to an axis 11 is shown as well as a plane P2 perpendicular to said axis. The axis 11 extends through an end 17 of a socket 5 and an extremity 19 of bulb 3. In all the embodiments shown in FIGS. 4 to 8 at least one plane, either plane P1 or plane P2 or both plane P1 and plane P2, crosses two or more times a boundary 10 between the cooling means 21 and the light transmittable surface 22 or sub-areas 23 thereof. In FIG. 4 plane P1 crosses said boundary three times, and plane P2 crosses no boundary 10. In FIG. 5 plane P1 crosses no boundary while plane P2 crosses said boundary 10 six times. In FIG. 6 plane P1 crosses said boundary two times, and plane P2 crosses no boundary 10. In FIG. 7 plane P1 crosses said boundary 10 one time, and plane P2 crosses said boundary six times. In FIG. 8 both plane P1 and plane P2 cross said boundary 10 eight times. In the lamp of FIG. 7 the bulb outer surface 15 has an interdigitated structure of the cooling means 21 and the sub-areas 23 of the light transmittable surface 22. The interdigitated structure extends in axial direction over a length L over the bulb outer surface 15. Preferably the length L should be at least ¼ of an axial height H of the bulb 3.

Figure 9:
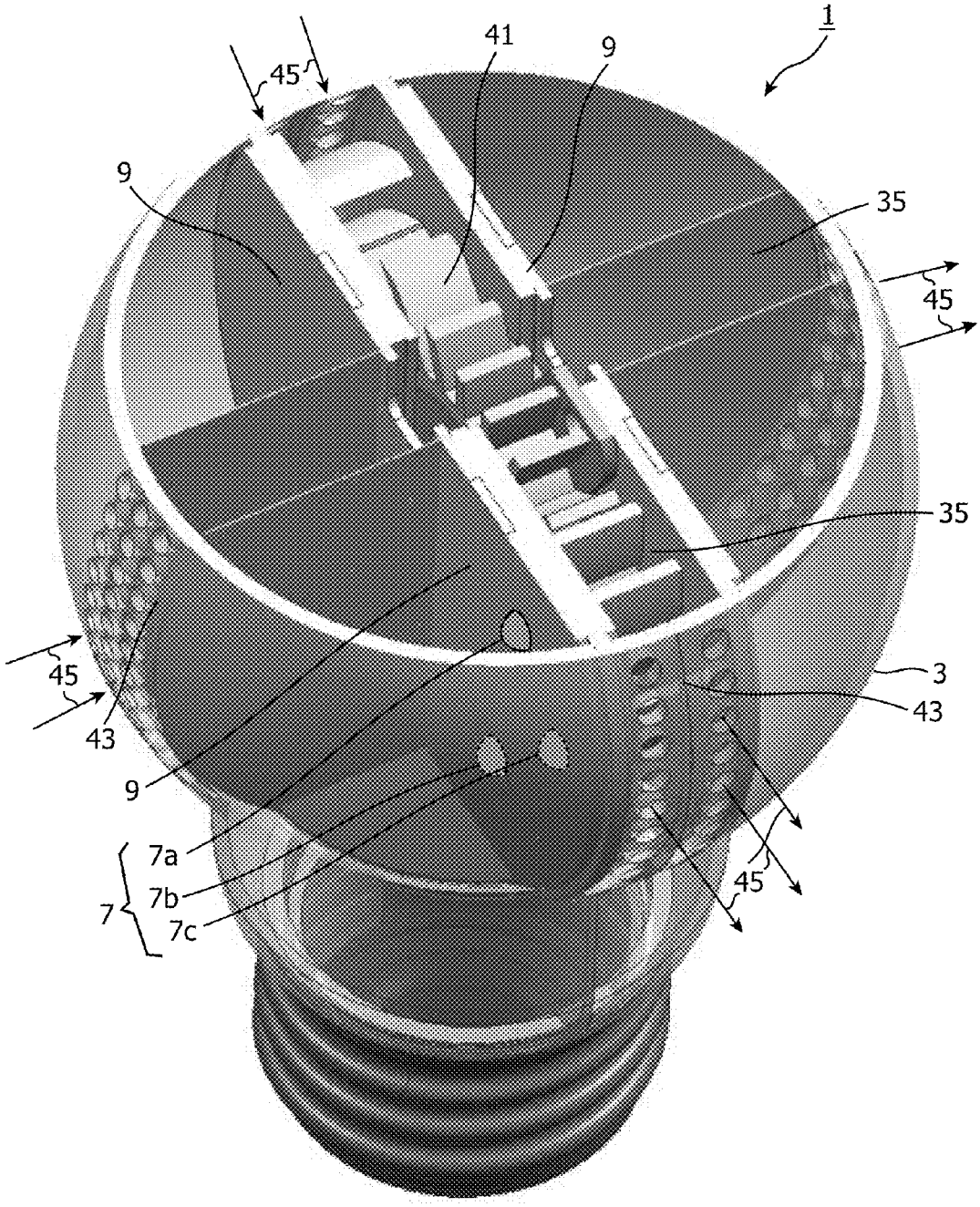
FIG. 9 shows a ninth embodiment of a lamp according to the invention.

FIG. 9 shows a vertical cross-section of a ninth embodiment of the lamp 1 according to the invention. The lamp is both an actively cooled and passively cooled lamp. Active cooling means 41, in the Figure a double fan working in two, transverse directions, are is provided inside a cavity 35 in the bulb 3 which enhances the cooling capacity an better control of the cooling of the lamp. Grates 43 are provided to enable forced flow of air, indicated by arrows 45, through the cavity. The cavity 35 has an outer wall formed by the PCBs 9 of heat conducting material, which thus acts as a passive cooling means, on which PCBs as light source 7 the LEDs 7*a*,7*b*,7*c* are mounted. Thus, efficient cooling of both the lamp is obtained.

The invention claimed is:

1. An electric lamp comprising:

a bulb mounted on a socket, cooling means for cooling the lamp during operation, a semiconductor light source arranged inside the bulb, a lamp axis extending through a central end of the socket and a central extremity of the bulb, the bulb having an outer surface comprising a light transmittable surface for transmitting light originating from the light source during operation of the lamp, wherein both the cooling means and the light transmittable surface are spread over the bulb outer surface, such that for an imaginary set of two planes, of which a first plane extends parallel to the axis and a second plane extends perpendicular to the axis, a position of said planes can be found in which at least one of said two planes crosses at least two times a boundary between the cooling means and the light transmittable surface;

said cooling means extending from inside the bulb to the outer surface of the bulb;

said light transmittable surface divided into sub-areas by the cooling means;

each of said sub-areas forming one integral light transmittable surface wherein the sub-areas and the cooling means are arranged in an alternating and interdigitated configuration extending axially over the length of the bulb;

each sub-area surrounded by a respective part of the cooling means and each of said sub-areas separated by at least two axially extending cooling arches.

2. An electric lamp as claimed in claim 1, characterized in that the sub-areas have the same shape and/or size.

3. An electric lamp as claimed in claim 1, characterized in that the sub-areas are separated by at least one annular cooling means around the axis.

4. An electric lamp as claimed in claim 1, characterized in that each sub-area is a light transmittable part which is releasably fixed onto the cooling means.

5. An electric lamp as claimed in claim 4, characterized in that said part is provided on a surface facing the light source with a remote phosphor coating, or a phosphor compound.

6. An electric lamp as claimed in claim 4, characterized in that said part is diffusely transparent or translucent.

7. An electric lamp as claimed in claim 4, characterized in that said part is an optical element.

8. An electric lamp as claimed in claim 4, characterized in that said part is releasably fixed via a click/snap connection.

9. An electric lamp as claimed claim 1, characterized in that the cooling means are formed as recesses that extend towards the axis.

10. An electric lamp as claimed in claim 1, characterized in that the cooling means comprise passive cooling means and active cooling means.

11. An electric lamp as claimed in claim 10, characterized in that the active cooling means comprise at least one means from the group consisting of fan, synjet, acoustic cooling and ionic cooling.

12. An electric lamp as claimed in claim 1, characterized in that the lamp is a DC-driven lamp and that the lamp has a central axially extending cavity in which a lamp driver is arranged.

13. An electric lamp as claimed in claim 1, characterized in that the lamp is an AC-driven lamp.

14. An electric lamp as claimed in claim 1, characterized in that the number of sub-areas is in the range of 2 to 8.

* * * * *